US006547135B2

(12) United States Patent
Solirenne et al.

(10) Patent No.: US 6,547,135 B2
(45) Date of Patent: Apr. 15, 2003

(54) ACCESS CONTROL CARD, PARTICULARLY FOR ACCESS TO AN AUTOMOTIVE VEHICLE

(75) Inventors: Didier Solirenne, Toulouse (FR); Frederic Chaillie, Toulouse (FR)

(73) Assignee: Siemens Automotive, Toulouse (FR)

( * ) Notice: Subject to any disclaimer, the term of this patent is extended or adjusted under 35 U.S.C. 154(b) by 0 days.

(21) Appl. No.: 09/946,731

(22) Filed: Sep. 6, 2001

(65) Prior Publication Data

US 2002/0033419 A1 Mar. 21, 2002

(30) Foreign Application Priority Data

Sep. 6, 2000 (FR) ..... 00 11331

(51) Int. Cl.[7] ..... G06K 5/00; G06K 7/10; G06F 17/00

(52) U.S. Cl. ..... 235/382; 235/375; 235/380; 235/454

(58) Field of Search ..... 235/375, 380, 235/382, 454

(56) References Cited

U.S. PATENT DOCUMENTS 4,575,621 A 3/1986 Dreifus ..... 235/380
4,720,824 A * 1/1988 Hayashi ..... 235/487
5,283,431 A 2/1994 Rhine ..... 250/229
5,959,289 A * 9/1999 Okada et al. ..... 235/487

FOREIGN PATENT DOCUMENTS

| | | | |
|---|---|---|---|
| EP | 0 351 183 | 1/1990 | |
| FR | 2 719 274 | 11/1995 | |
| FR | 2 778 014 | 10/1999 | |
| GB | 2 165 423 | 10/1999 | |
| JP | 01116893 A * | 5/1989 | ..... G06K/17/00 |
| JP | 4-323097 | 3/1993 | |
| WO | WO 93/15935 | 4/1986 | |

* cited by examiner

*Primary Examiner*—Thien M. Le
*Assistant Examiner*—April Nowlin
(74) *Attorney, Agent, or Firm*—Young & Thompson

(57) ABSTRACT

This electronic card (10) is adapted to coact with a reader (2), one edge of the card however remaining outside the reader. It has at least one light wave guide (24) integrated into the thickness of the latter, opening on one edge (16) of the card and permitting carrying a light wave when the card (10) is introduced into the reader (2) from within the interior of the reader to the external edge of the card and/or vice versa.

10 Claims, 1 Drawing Sheet

ACCESS CONTROL CARD, PARTICULARLY FOR ACCESS TO AN AUTOMOTIVE VEHICLE

The present invention relates to an access control card, particularly for access to an automotive vehicle.

It is known in the automotive field to replace a conventional key coacting with a mechanical lock, with a card containing an electronic device. To gain access to a vehicle, the card emits a signal toward a receiver located in the passenger compartment of the vehicle. If the receiver recognizes the card, access to the vehicle is authorized. The information received by the receiver is for example supplied to a device permitting controlling opening and closing of the car doors. The card can also serve as a contact key and a reader is located in this case also in the passenger compartment.

It is interesting for the user to receive information following introduction of his card into the reader, to know for example whether the doors are open or closed. It is thus known to provide the reader or even the card, with luminous indicators, of the luminous diode type known as LEDs, or the like.

The drawback of these devices is their size. Thus, it is for example known to integrate indicators on the edge of a card, but this leads to a relatively thick card. Similarly, if the indicators are integrated into the reader, the latter must have on its front surface, in addition to the opening designed to receive the card, the indication and/or control indicators.

The present invention thus has for its object to provide a compact system. As follows from the above, it is preferable, to gain space at the reader, to read the information from the card. The present invention thus has for its object to provide a card of reduced size which however permits supplying luminous information, as well as a reader associated with this card.

To this end, it provides an electronic access control card, particularly for automotive vehicles, adapted to coact with a reader or the like, this reader comprising a recess to receive the card, leaving however an edge projecting outside the recess.

According to the invention, the card has at least one luminous wave guide integrated into its thickness, opening on the edge of the card adapted to remain outside the reader or the like, and permitting sending a luminous wave when the card is introduced into the reader, from the reader toward this edge of the card and/or vice versa.

The presence of a luminous wave guide in the card thus permits having a luminous source in the reader (or the like), at a place where there is no size problem, and to direct the light emitted by the source to the external edge of the card, which is visible when the latter is engaged in the reader. Known wave guides can have a very small thickness and be easily integrated into the card without substantially increasing the size of the latter. Luminous wave guides permit avoiding an exchange of information between the card and the reader, which controls a light source disposed on the card.

It is also foreseeable to cause a light beam to pass from outside the reader (or the like) and the card, to within the reader. Instead of thus providing a light source in the reader, a detector can be provided there.

In a preferred embodiment permitting having a relatively short optical path through the wave guide, and hence good transmission of the light rays, the luminous wave guides, at least one in number, have an elbowed shape so as to permit guiding the waves from a surface of the card toward an edge of the latter. It is also foreseeable to have a wave guide passing through the card from side to side but this requires having a fairly long wave guide, which risks attenuating the carried light signal.

An access control card according to the invention can also integrate a light source. This latter gives for example information as to the card itself (condition of charge of a battery, etc.). In this case, the light source is preferably disposed such that the light which it emits is guided by a wave guide. A user thus does not distinguish between information from the card and information from the reader.

An embodiment of the access control card comprises a parallelepipedal envelope of small thickness having two large surfaces and four edges, with at least one opening provided in an edge of the card, a corresponding opening provided in a large surface of the card and these two corresponding openings being connected by a luminous wave guide.

The present invention also relates to an identification device comprising a recess adapted to receive an electronic control card through an opening, one edge of the card extending outside this opening, and being adapted to coact with an access control card as described above.

Such an identification device comprises for example at least one light source adapted to face the card when the latter has been introduced into the device. In this case, the light source is located for example below the card when the latter is introduced into the device, adjacent the opening adapted to receive the card.

Such an identification device can also comprise a photo cell adapted to face the card when the latter has been introduced into the device. This cell thus permits detecting the light entering into the reader via a wave guide of the card.

BRIEF DESCRIPTION OF THE DRAWINGS

The characteristics and advantages of the invention will become moreover apparent from the description which follows, given by way of non-limiting example, with reference to the accompanying drawing, in which.

DETAILED DESCRIPTION OF THE PREFERRED EMBODIMENTS

Figure 1:
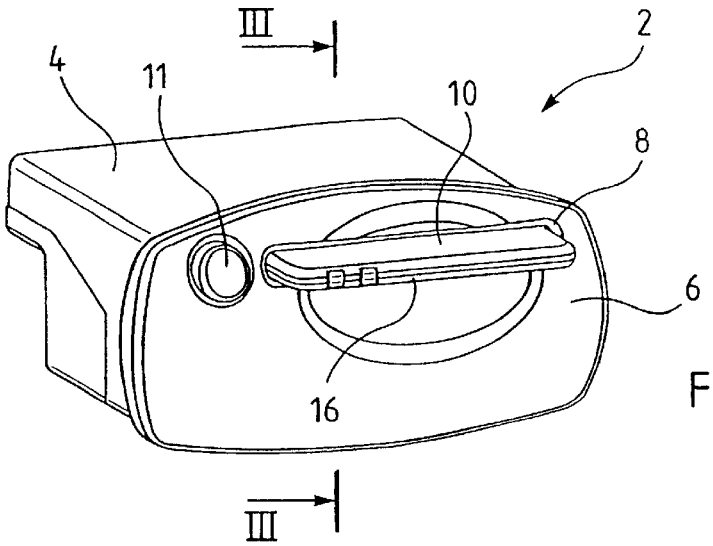
FIG. 1 is a perspective view of an identification device into which has been introduced an access control card.

FIG. 1 shows a reader 2, or identification device, comprising a housing 4 having a front surface 6 in which is provided an opening 8 giving access to a recess adapted to receive an access control card 10. A button 11 is moreover provided to release the card 10 when the latter must be withdrawn from the reader.

The illustrated reader 2 is for example an electronic device adapted to replace in an automotive vehicle the lock receiving the contact key. It is already known in an automobile, to replace the contact key with an electronic card.

In the embodiment shown in the drawing, the card 10 comprises an external envelope 12, for example of synthetic material, in which is located the electronic components disposed on a printed circuit 14. The envelope 12 has a parallelepipedal shape of very small thickness. It thus has two surfaces and four side walls forming the four edges of the card 10. When the card 10 is introduced into the reader 2, one edge, hereinafter called the front edge 16, still projects from the housing 4. The opposite edge of the front edge 16, or rear edge 18, is provided with means known to those skilled in the art and not described here in detail, permitting good holding of the card 10 in the reader 2 and its locking. The locking means coact in known manner with the button 11 for releasing the card 10.

Figure 2:
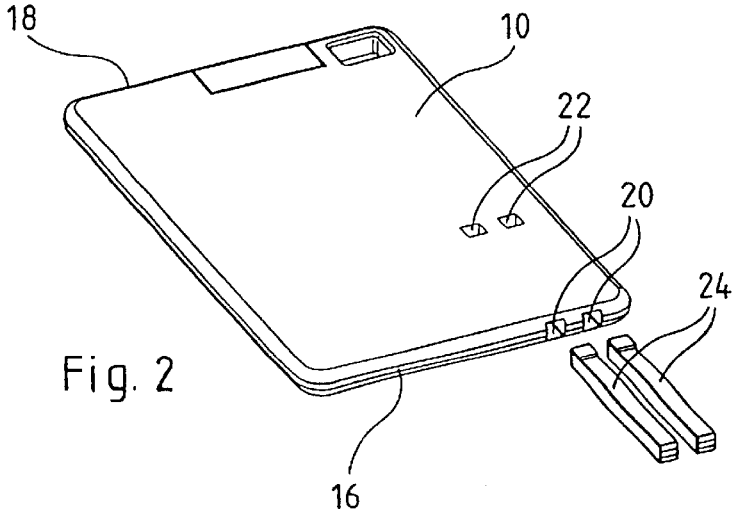
FIG. 2 is an exploded perspective view of the card of FIG. 1.
Figure 3:
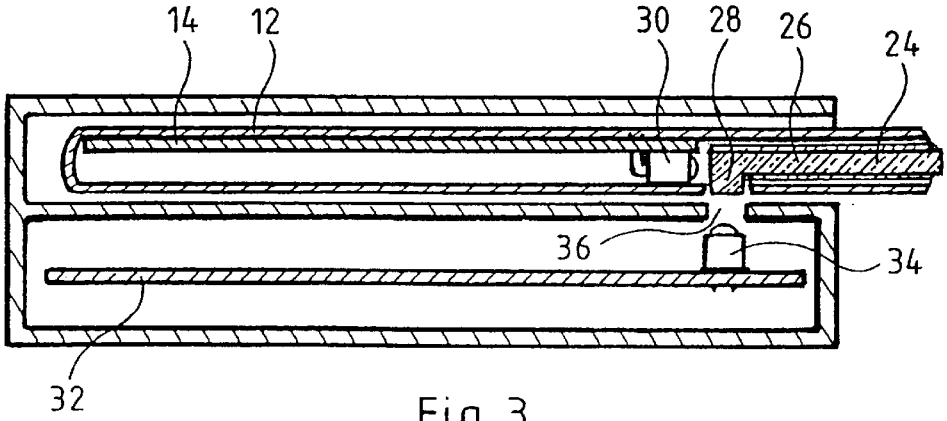
FIG. 3 is a cross-sectional view on an enlarged scale, on the section line III—III of FIG. 1.

The envelope 12 comprises on the front edge 16 two openings 20, substantially square. One surface of the envelope itself also has two openings 22 that are substantially square. FIG. 2 shows the card 10 in inverted position relative to the views of FIGS. 1 and 3 so as to better show these openings 22.

An opening 22 corresponds to each of the openings 20. A light wave guide 24 connects each opening 20 on the front edge 16, with an opening 22 on the surface of the envelope. It is made of a material permitting guiding light waves from an opening 20 toward an opening 22, and vice versa. The shape of this light wave guide 24 is elbowed, the bend being located facing an opening 22. One relatively long arm 26 thus extends in the plane of the card 10 whilst a short arm 28 extends perpendicular to this plane. The free end of the long arm 26 is flush or even projects relative to the level of the corresponding opening 20, whilst the other free end of the guide 24, at the end of the short arm 28, is flush with or projects from the corresponding opening 22. A transverse cross-section of the wave guide 24 at each of its two arms 26 and 28 is substantially square. The size of this square corresponds substantially to the size of the openings 20 and 22.

The printed circuit 14 carries on one of its surfaces a luminous diode 30, or LED. This latter is disposed in prolongation of the arm 26 of one of the light wave guides within the card 10 and is oriented such that the light which it emits is directed toward the light wave guide 24. Thus, the light emitted by the diode 30 is visible through the corresponding opening 20 in the front edge 16 of the card.

The reader 2 also comprises a printed circuit 32 on which is mounted for example a luminous diode 34, or LED. This latter is disposed such that it is located in prolongation of the arm 28 (short) of a light wave guide 24 and emits its light rays toward this wave guide 24. Of course, no obstacle opaque to the light emitted by the diode 34 is located between the latter and the corresponding light wave guide 24. If necessary, an opening 36 can be provided in the reader 2 so as not to disturb the transmission of light between the diode 34 and the light wave guide 24. Thanks to its properties, the wave guide 24 will guide the light rays from the diode 34 to the corresponding opening 20.

The device described above provides a card 10 of reduced size, particularly as to thickness, and a reader whose front surface comprises only a slot 8 for introduction of the card and if desired a button 11 to release the card for its withdrawal from the device. This is interesting in certain environments, particularly in the passenger compartment of an automobile, where the saving of space is very appreciable because it is necessary to house a large number of devices in a limited space. Moreover, despite its reduced size, this reader and card assembly has luminous control and/or information indicators. These indicators are located on the front surface 16 of the card 10. Thus, through its openings 20, a user can see the light emitted by the diodes 30 and 34. For this user, it is as though an indicator, or a diode, is integrated into the card 10, at the edge 16. Information can thus be transmitted from the reader 2 via the diode 34 to the user, and this takes place without making the card thicker and without increasing the size of the visible portion of the reader. The illumination of an indicator can for example inform the user as to the condition of the vehicle (locking, motor turning or not, etc). The diode 30 integrated into the card 10 can itself for example give information as to the charge level of the battery.

It is also foreseeable to use one or several light wave guides to transmit information to the reader 2. In this case, the luminous diode 34 can be replaced by a detector, disposed for example like the diode 34, and receiving light from outside. A wave guide 34 thus serves for example to direct a light beam (ambient light or the like) from the cockpit of the corresponding automobile to the reader. By means of the detector, the light is detected and then used. It is possible thus to control the illumination of a ceiling light if the reader 2 is electrically connected to the control electronics of this illumination.

The light wave guide or guides 24 do not necessarily operate in the range of visible light. They can also carry direct infrared (IR) rays. The card 10 and the reader 2 can thus form an assembly connecting with an electronic unit (navigation system for example) which will be activated by remote infrared control available to the user, here the driver of the automobile.

In case communication is established by means of the assembly formed by the card 10 and the reader 2, automatic locking of the card 10 and the reader 2 can be provided. Once the communication is completely established, this can mean that the card is in a good position in the reader 2. The mechanical locking of the card can thus be controlled.

The present invention is of course not limited to the details of the embodiments which have been described by way of example, various modifications being within the scope of one skilled in the art without departing from the scope of the invention defined by the following claims.

Thus, for example, the shape of the described card could vary, to have a circular, triangular or other shape.

The presence of a luminous diode in the card is optional. The scope of the invention would not be exceeded by eliminating the described diode.

The field of application of the described card or reader is not limited to access control in an automotive vehicle. Such a card can serve to control access for example to a building or to services (in an input connection or terminal)

The reader can combine both at least one light source and at least one detector. It can also comprise only light sources or detectors.

What is claimed is:

1. Electronic access control card adapted to coact with a reader, the reader comprising a recess to receive the card leaving an edge of the card extending outside the recess, wherein the card has at least one light wave guide integrated into a thickness of the card, opening on the edge of the card adapted to remain outside the reader and permitting carrying a light wave when the card is introduced into the reader, from at least one of within the reader toward the edge of the card and from the card toward the reader.

2. The access control card according to claim 1, wherein the at least one light wave guide has an elbowed shape so as to permit guiding waves from a surface of the card toward an edge of the card.

3. The access control card according to claim 1, wherein the card also includes a light source.

4. The access control card according to claim 3, wherein the light source is disposed such that the light that the light source emits is guided by one of said at least one wave guide.

5. The access control card according to claim 1, wherein the card comprises a paralellepipedal envelope of small thickness having two large surfaces and four edges, wherein at least one opening is provided in an edge of the card, and wherein a corresponding opening is connected to a large surface of the card and wherein the at least one opening and the corresponding opening are connected by a light wave guide.

6. A reader comprising a recess adapted to receive, through an opening, an electronic control card, according to claim 1, one edge of the card extending outside the opening, wherein the reader comprises at least one light source adapted to face the card when the card has been introduced into the reader.

7. The reader according to claim 6, wherein the light source is below the card when the card is introduced into the device, adjacent the opening adapted to receive the card.

8. The reader according to claim 6, further comprising a photosensitive cell adapted to face the card when the card has been introduced into the reader.

9. A reader comprising a recess adapted to receive, through an opening, an electronic control card, according to claim 1, one edge of the card extending outside this opening, wherein the reader comprises at least one photosensitive cell adapted to face the card when the card has been introduced into the reader.

10. The reader according to claim 9, wherein the photosensitive cell is located below the card when the card has been introduced into the reader, adjacent the opening adapted to receive the card.

* * * * *